US009770910B2

(12) United States Patent
Ros Cerro et al.

(10) Patent No.: US 9,770,910 B2
(45) Date of Patent: Sep. 26, 2017

(54) COLLECTOR SUBSTRATE ADVANCEMENT TO COLLECT FLUID

(75) Inventors: Francesc Ros Cerro, Sant Vicent de Montalt (ES); Daniel Gutierrez Garcia, Badalona (ES); Marcia Sole Pons, Sant Quirze del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 54 days.

(21) Appl. No.: 14/394,984

(22) PCT Filed: May 24, 2012

(86) PCT No.: PCT/US2012/039253

§ 371 (c)(1),
(2), (4) Date: Oct. 16, 2014

(87) PCT Pub. No.: WO2013/176669

PCT Pub. Date: Nov. 28, 2013

(65) Prior Publication Data

US 2016/0052282 A1 Feb. 25, 2016

(51) Int. Cl.
*B41J 2/17* (2006.01)
*B41J 11/08* (2006.01)

(52) U.S. Cl.
CPC ..... *B41J 2/1721* (2013.01); *B41J 11/08* (2013.01); *B41J 2002/1728* (2013.01); *B41J 2002/1735* (2013.01); *B41J 2002/1742* (2013.01)

(58) Field of Classification Search
CPC ..... B41J 2002/1742; B41J 2/1721; B41J 2002/1735; B41J 2002/1728; B41J 11/08
See application file for complete search history.

(56) References Cited

U.S. PATENT DOCUMENTS 5,291,227 A * 3/1994 Suzuki ..... B41J 2/1721 347/104
7,497,564 B2 3/2009 Yui
(Continued)

FOREIGN PATENT DOCUMENTS

KR 20000040189 A 7/2000
KR 10-2004-0032207 A 4/2004

*Primary Examiner* — Henok Legesse
(74) *Attorney, Agent, or Firm* — HP Inc.—Patent Department

(57) ABSTRACT

An image forming system includes a fluid applicator unit, a substrate positioning unit, and a fluid collector assembly. The fluid collector assembly includes a collector substrate, a collector advancement unit, and a collector control module. The fluid applicator unit may apply fluid to a substrate. The substrate positioning unit may position the substrate in a printzone to receive the fluid from the fluid applicator unit such that a first portion of the fluid remains on the substrate and a second portion of the fluid does not remain on the substrate. The collector substrate may collect the second portion of the fluid in the printzone below the substrate. The collector advancement unit may advance the collector substrate along a collector transport path below the substrate in the printzone. The collector control module may control the collector advancement unit to selectively advance the collector substrate along the collector transport path in response to application of the fluid to the substrate by the fluid applicator unit.

20 Claims, 8 Drawing Sheets

(56) References Cited

U.S. PATENT DOCUMENTS

| | | | | |
|---|---|---|---|---|
| 7,954,921 | B2 | 6/2011 | Ben-Zur et al. | |
| 2004/0104964 | A1* | 6/2004 | Niekawa | B41J 2/2103 347/40 |
| 2004/0109050 | A1* | 6/2004 | Yang | B41J 2/16508 347/90 |
| 2007/0206038 | A1 | 9/2007 | Baker | |
| 2007/0236535 | A1 | 10/2007 | Baker et al. | |
| 2009/0122106 | A1 | 5/2009 | Ray | |
| 2011/0271861 | A1 | 11/2011 | Anglada et al. | |
| 2012/0001985 | A1 | 1/2012 | Kumagai et al. | |
| 2013/0257980 | A1* | 10/2013 | Ibe | B41J 2/1652 347/35 |

* cited by examiner

COLLECTOR SUBSTRATE ADVANCEMENT TO COLLECT FLUID

BACKGROUND

Image forming systems may include substrate positioning units to position substrates in a printzone. The image forming systems may also include a fluid applicator unit to apply fluid such as ink to a substrate in the printzone to form images thereon. At times, a portion of the fluid received by the substrate may subsequently be transferred to components of the image forming system.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Image forming systems may include a substrate positioning unit to position a substrate in a printzone and a fluid applicator unit to apply fluid such as ink to the substrate positioned in the printzone to form images thereon. The image forming systems may include a stationary absorber to absorb fluid not retained by the substrate that may require frequent replacement and manual intervention including unloading of the substrate. Additionally, the absorber may have an increased thickness to increase an amount of fluid it can retain before becoming oversaturated. Further, the absorber may limit a user from obtaining feedback and/or an ability to identify the collector substrate's saturation state and change its rate of saturation. Accordingly, the productivity of the image forming system, the lifespan of the collector substrate, and the range of substrates and/or sizes thereof that may be used with the image forming system may be reduced.

In examples, an image forming system includes, amongst other things, a fluid collector assembly. The fluid collector assembly includes a collector substrate, a collector advancement unit, and a collector control module. The collector substrate may collect a second portion (e.g., fluid not retained on the substrate) of the fluid in the printzone below a substrate. The collector advancement unit may advance the collector substrate along a collector transport path below the substrate in the printzone. The collector control module may control the collector advancement unit to selectively advance the collector substrate along the collector transport path in response to application of the fluid to the substrate by the fluid applicator unit. Thus, the selective advancement of the collector substrate may reduce the frequency and complication of collector substrate replacement, decrease a thickness of the collector substrate, and provide a user with feedback and/or an ability to identify the collector substrate's saturation state and change its rate of saturation. Accordingly, the productivity of the image forming system, the lifespan of the collector substrate, and the range of substrates and/or sizes thereof that may be used with the image forming system may be increased.

Figure 1:
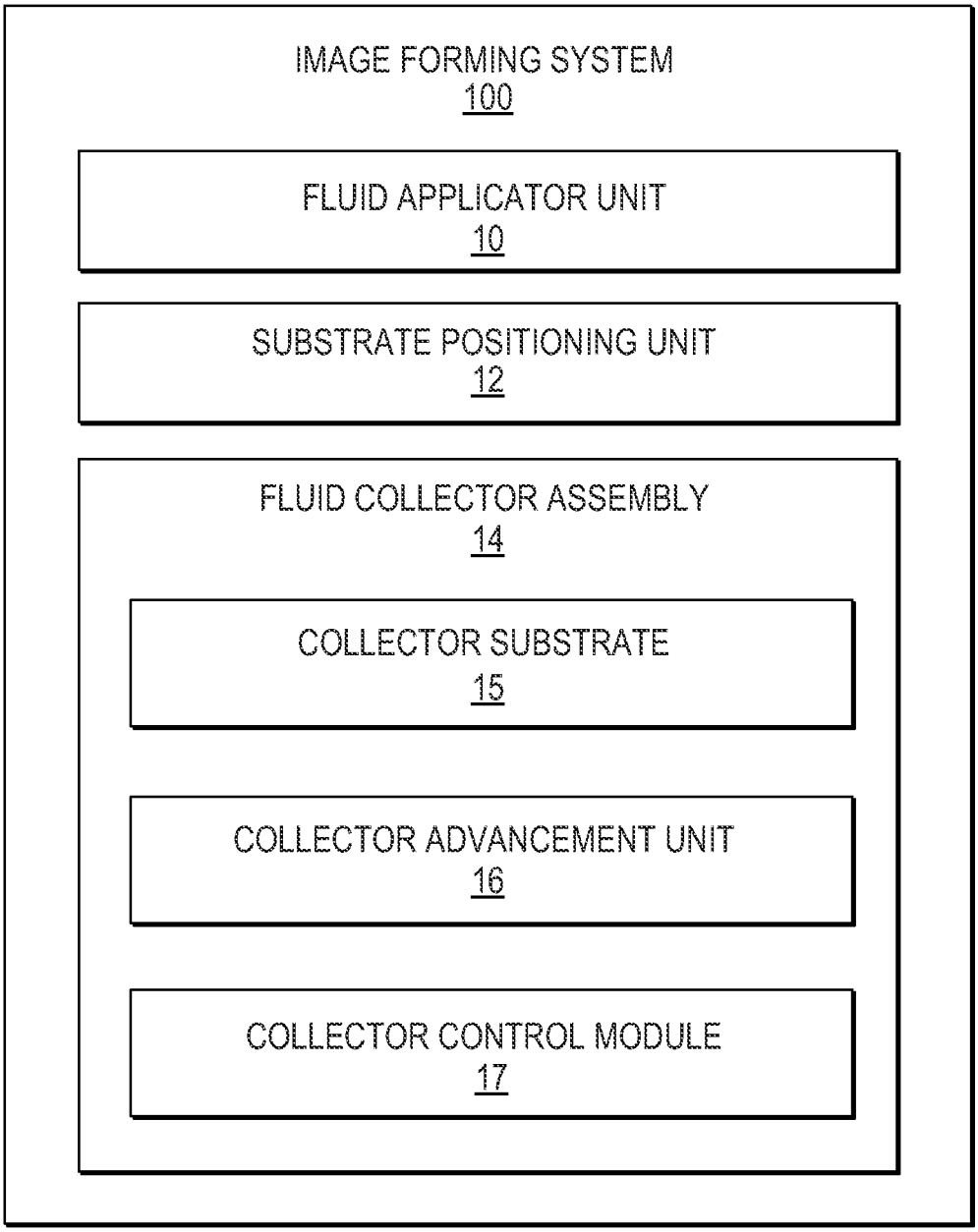
FIG. 1 is a block diagram of an image forming system according to an example.

FIG. 1 is block diagram of an image forming system according to an example. Referring to FIG. 1, in some examples, an image forming system 100 includes a fluid applicator unit 10, a substrate positioning unit 12, and a fluid collector assembly 14. The fluid collector assembly 14 may include a collector substrate 15, a collector advancement unit 16, and a collector control module 17. The fluid applicator unit 10 may apply fluid to a substrate. In some examples, the fluid applicator unit 10 may include a single or plurality of inkjet print heads to form images on the substrate. For example, the fluid applicator unit 10 may be a page wide inkjet print head array that includes a plurality of inkjet print heads extending across a width of a substrate. In some examples, the plurality of print heads may move along a transport path to apply fluid to the substrate. Alternatively, the plurality of print heads may be stationary and the substrate may be transported along the transport path.

In some examples, the substrate may include paper, vinyl, plastic, textile, wallpaper, and the like. The substrate positioning unit 12 may position the substrate in a printzone to receive the fluid from the fluid applicator unit 10 such that a first portion of the fluid remains on the substrate and a second portion of the fluid does not remain on the substrate. For example, the substrate may be a porous material in which some of the fluid applied thereto by the fluid applicator unit 10 may pass there through. Referring to FIG. 1, in some examples, the collector substrate 15 may collect the second portion of the fluid in the printzone below the substrate. For example, the collector substrate 15 may receive and absorb fluid such as the second portion of fluid not retained by the substrate. In some examples, the collector substrate 15 may include blends of Polyester bases including cellulose and Sodium Borate Decahydrate, filaments of Polyester and Polyamide, and the like. Additionally, in some examples, the collector substrate 15 may have a thickness less than 0.5 millimeters. For example, the collector substrate 15 may have a thickness t in a range of 0.15 mm to 0.25 mm. Thus, for example, the collector substrate 15 may include a thin substrate that adequately absorbs fluid applied by the fluid applicator unit 10 that does not remain on the substrate by automatic advancement thereof. That is, a fluid collector assembly 14 that selectively and progressively renews portions of the collector substrate 15 to be disposed to receive the second portion of the fluid enables the collector substrate 15 to be cost-effective, thin and less-obtrusive to the positioning of the substrate in the printzone, for example, to be printed on. In some examples, the fluid may include ink such as latex ink, ultraviolet (UV) curable ink, and the like. The latex ink and UV curable ink, for example, may cure on the surface of the collector substrate 15.

Referring to FIG. 1, in some examples, the collector advancement unit 16 may advance the collector substrate 15 along a collector transport path below the substrate in the printzone. The collector control module 17 may control the collector advancement unit 16 to selectively advance the collector substrate 15 along the collector transport path in response to application of the fluid to the substrate by the fluid applicator unit 10. For example, while the fluid applicator unit 10 is applying the fluid to the substrate the collector substrate 15 may automatically and progressively advance the collector substrate 15 along the collector transport path through the printzone below the substrate.

Figure 2:
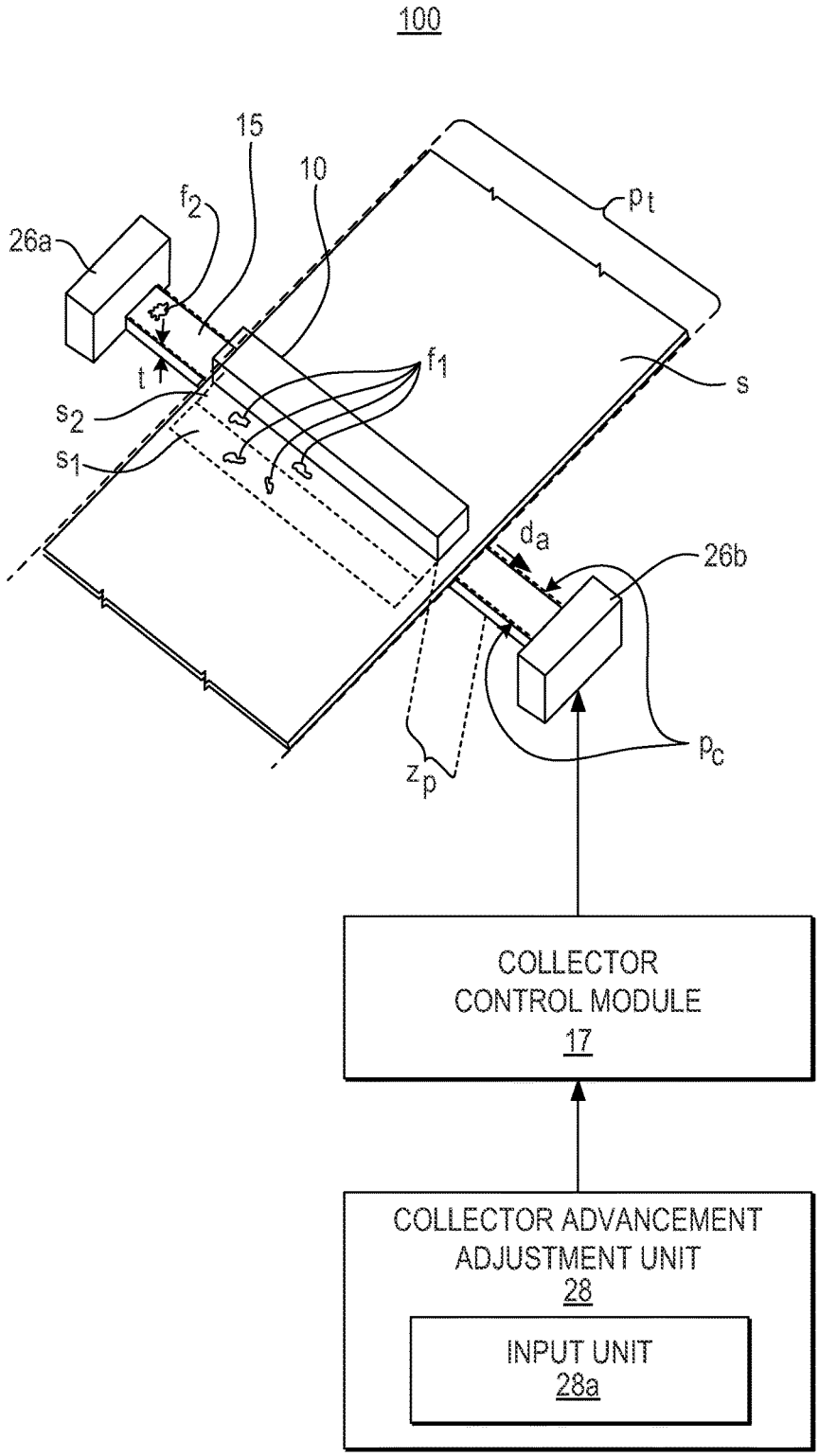
FIG. 2 is a schematic view illustrating the image forming system of FIG. 1 according to an example.

FIG. 2 is a schematic view illustrating the image forming system of FIG. 1 according to an example. Referring to FIG. 2, in some examples, an image forming system 100 includes the fluid applicator unit 10, the substrate positioning unit 12 (FIGS. 3A-5), and the fluid collector assembly 14 including the collector substrate 15, the collector advancement unit 16, and the collector control module 17 as previously disclosed with respect to FIG. 1. In some examples, the collector control module 17 may control the collector advancement unit 16 to selectively advance the collector substrate 15 along the collector transport path $p_c$ in response to application of the fluid to the substrate s by the fluid applicator unit 10 at a collector advancement speed.

For example, the collector control module 17 may control the collector advancement unit 16 to continually move the collector substrate 15 in an uninterrupted manner at the collector advancement speed such as in an advance direction $d_a$ while the fluid applicator unit 10 is applying the fluid to the substrate s. Additionally, the collector control module 17 may control the collector advancement unit 26*a* and 26*b* (collectively 16) to maintain the collector substrate 15 stationary when the fluid applicator unit 10 is not applying fluid to the substrate s. For example, during the sequential application of swaths $s_1$ and $s_2$ to form an image on the substrate s by the fluid applicator unit 10, the collector substrate 15 may move in an advance direction $d_a$ at a collector advancement speed to position the collector substrate 15 and/or a different portion thereof in the printzone $z_p$ and below the substrate s to receive a second portion $f_2$ of the fluid not remaining on the substrate s. In some examples, the collector substrate 15 may be advanced by discrete movements in response to application of the fluid to the substrate s by the fluid applicator unit 10. For example, the collector substrate 15 may be advanced a predetermined amount with respect to each printed swath.

Referring to FIG. 2, in some examples, the collector transport path $p_c$ may be at least one of substantially perpendicular to a transport path $p_t$ of at least the fluid applicator unit 10 and/or the substrate s. For example, in some examples, the transport path $p_t$ may include a path along which the substrate s is moved to and away from the printzone $z_p$. Alternatively, in some examples, the transport path $p_t$ may include a path along which the fluid applicator unit 10 is moved to and away from the printzone $z_p$ to apply fluid to the substrate s. In some examples, the image forming system 100 may also include a collector advancement adjustment unit 28. The collector advancement adjustment unit 28 may include an input member 28*a* to allow a user to change a collector advancement parameter corresponding to advancement of the collector substrate 15 in real-time. For example, the selective advancement of the collector substrate 15 may allow identification by a user of a rate of saturation thereof. That is, a user may visual inspect and a portion of the collector substrate 15 during operation of the image forming system 100 to determine an amount of the second portion $f_2$ of fluid received thereon and adjust the collector advancement parameter through the input member 28*a* of the collector advancement adjustment unit 28.

The collector advancement adjustment unit 28 may communicate adjustment information to the collector control module 17. In some examples, the collector advancement adjustment unit 28, and/or the collector control module 17 may be implemented in hardware, software, or in a combination of hardware and software. In some examples, the collector advancement adjustment unit 28, and/or the collector control module 17 may be implemented in part as a computer program such as a set of machine-readable instructions stored in the image forming system 100, locally or remotely. For example, the computer program may be stored in a memory such as a server or a host computing device. In some examples, the collector advancement parameter may include a collector advancement speed. The collector advancement speed may be a predetermined speed based on the type of printmode, the media porosity, configured ink limit, and/or the like. For example, a higher speed may be used for the collector advancement speed when a more porous substrate s is used to reduce oversaturation of the collector substrate 15. In some examples, a user may increase or decrease a current collector advancement speed, select a new collector advancement speed, and/or identify a new collector advancement speed, and the like, for example, based on particular conditions to optimize usage of the collector substrate 15.

Referring to FIG. 2, in some examples, the collector advancement unit 16 may include a first storage collector member 26*a* disposed at one end of the collector transport path $p_t$ and a second collector storage unit 26*b* disposed at another end of the collector transport path $p_c$. The first collector storage unit 26*a* may store the collector substrate 15 to be selectively advanced along the collector transport path $p_c$ to the printzone $z_p$ and, subsequently, to the second collector storage unit 26*b*. For example, the collector substrate 15 may be in a form of a replaceable consumable roll. The second collector storage unit 26*b* may receive the collector substrate 15 selectively advanced from the first collector storage unit 26*a*. For example, in an installed state, the collector substrate 15 may extend along the collector transport path $p_c$ in a state of tension between the first collector storage unit 26*a* and the second collector storage unit 26*b*. In some examples, the collector substrate has a thickness less than 0.5 millimeters. For example, the collector substrate 15 may have a thickness t in a range of 0.15 mm to 0.25 mm.

Figure 3A:
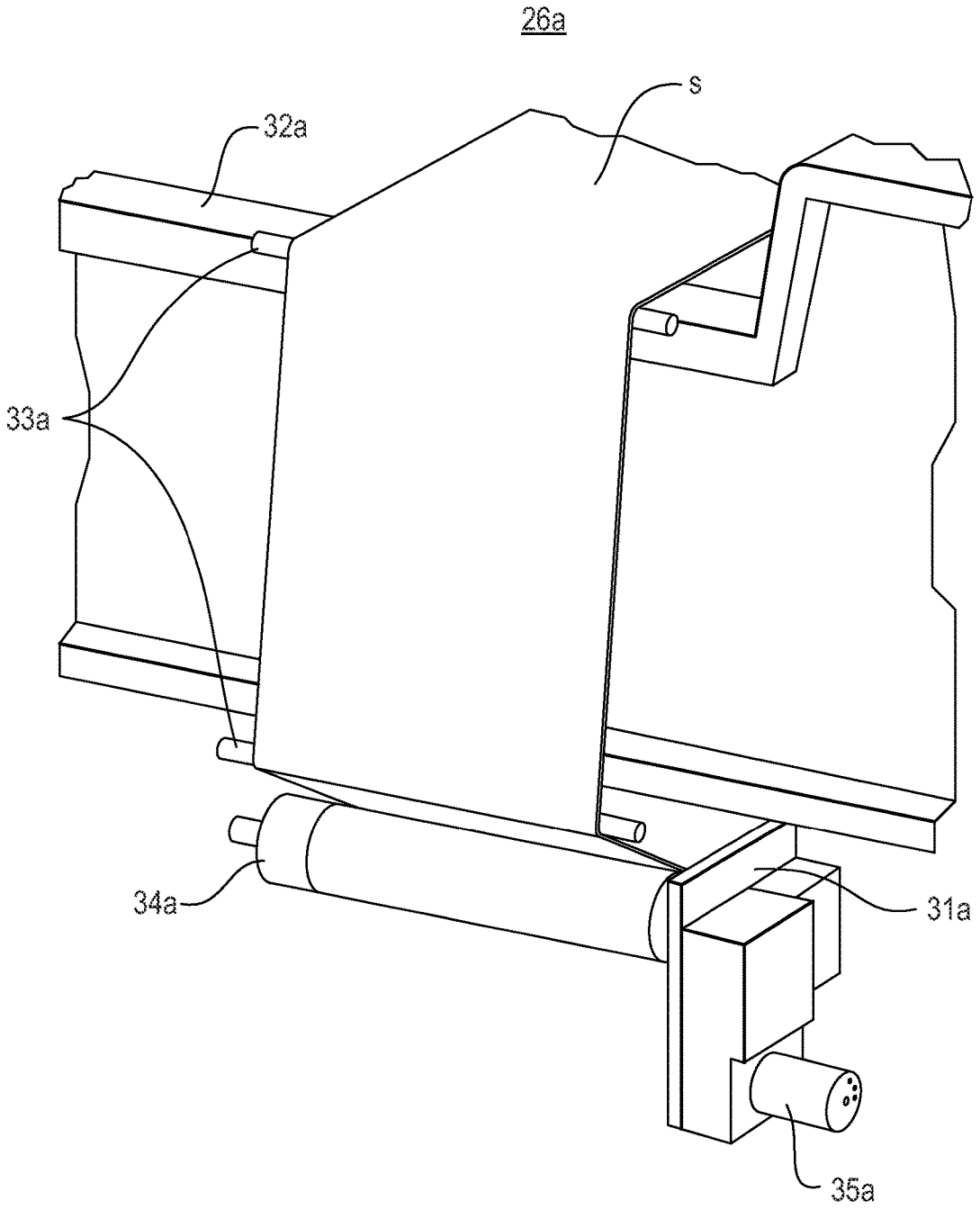
FIG. 3A is a perspective view illustrating a first collector storage unit of a collector advancement unit of the image forming system of FIG. 1 according to an example.
Figure 3B:
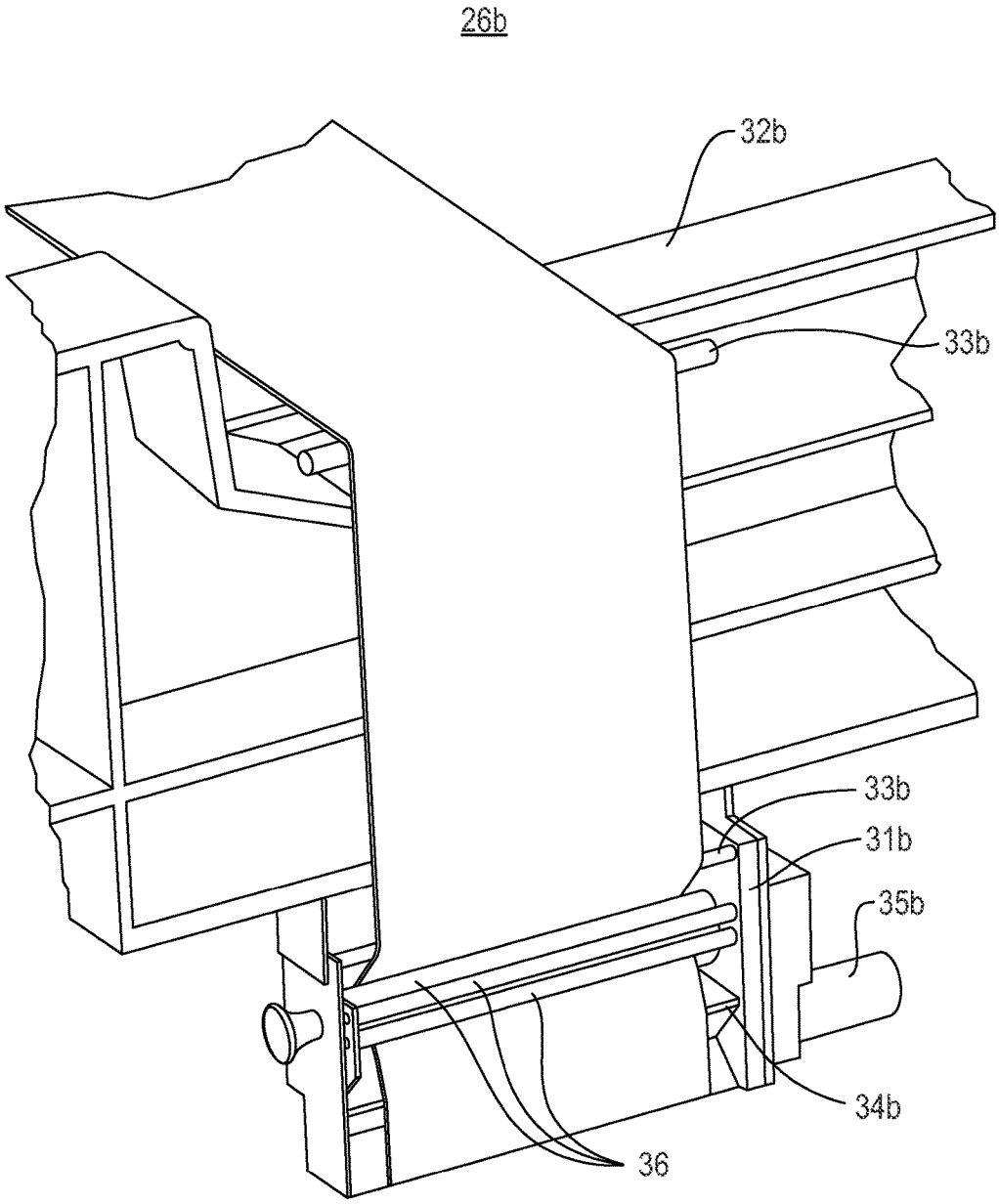
FIG. 3B is a perspective view illustrating a second collector storage unit of the collector advancement unit of the image forming system of FIG. 1 according to an example.

FIG. 3A is a perspective view illustrating a first collector storage unit of a collector advancement unit of the image forming system of FIG. 1 according to an example. FIG. 3B is a perspective view illustrating a second collector storage unit of the collector advancement unit of the image forming system of FIG. 1 according to an example. Referring to FIG. 3A, in some examples, the first collector storage unit 26*a* may include a first frame member 31*a*, a first guide member 32*a* to guide the collector substrate 15 away from the first collector storage unit 26*a*, a first set of guide rollers 33*a* to redirect the collector substrate 15, a holding cylinder 34*a* coupled to the first frame member 31*a* to removeably receive the collector substrate 15 in a form of a roll, and a first motor 35*a* coupled to the first frame member 31*a* to turn the holding cylinder 34*a* to place the collector substrate 15 in a state of tension.

Referring to FIG. 3B, in some examples, the second collector storage unit 26*b* may include a second frame member 31*b*, a second guide member 32*b* to guide the collector substrate 15 toward the second collector storage unit 26*b*, a second set of guide rollers 33*b* to redirect the collector substrate 15, a receiving member 34*b* coupled to the second frame member 31*b* to receive the collector substrate 15 in a form of a roll, a second motor 35*b* coupled to the second frame member 31*b* to turn the receiving member 34*b* to receive the collector substrate 15, and feeding members 36 to place a leading end of the collector substrate 15 in an installed state in the second collector storage unit 26*b*. In some examples, the first motor 34*a* and the second motor 34*b* may be placed in a master-slave relationship.

Figure 4A:
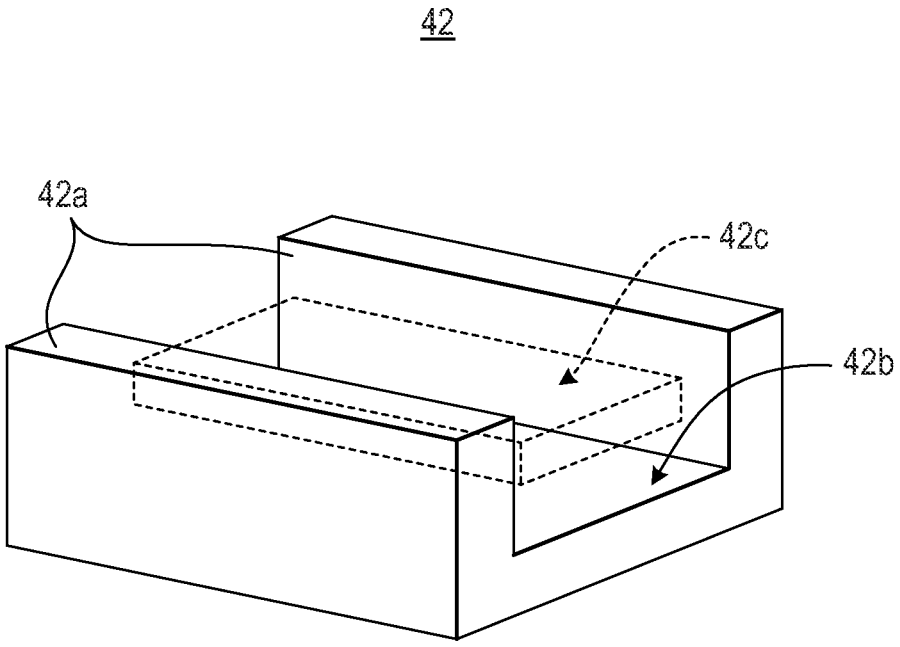
FIG. 4A is a perspective view illustrating a platen of the image forming system of FIG. 1 according to an example.
Figure 4B:
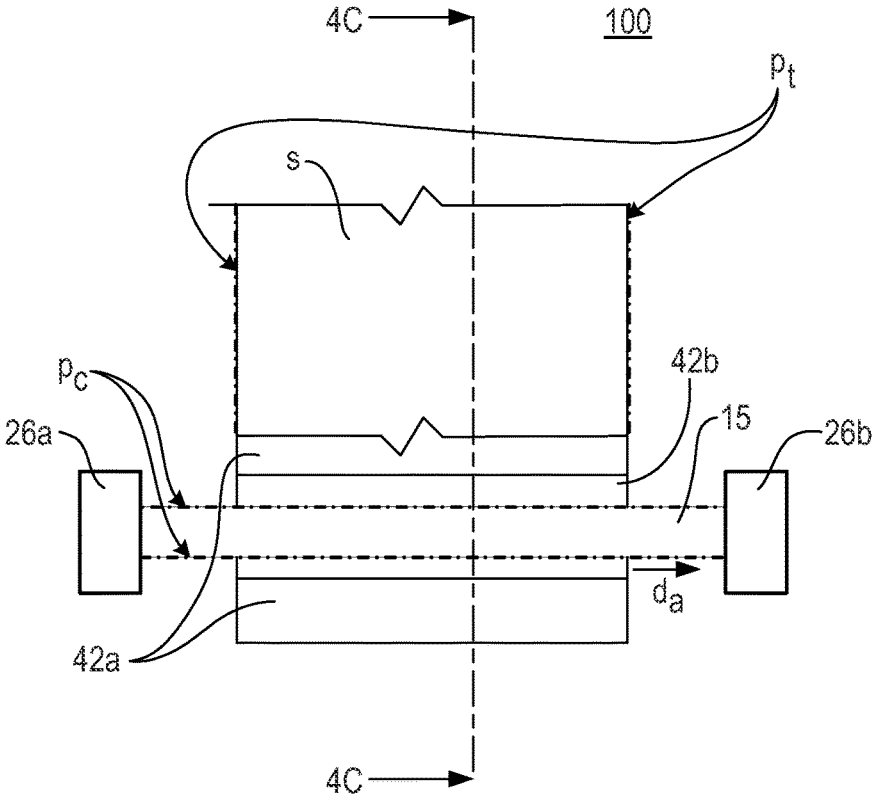
FIG. 4B is a schematic top view of a portion of the image forming system of FIG. 1 including the platen according to an example.
Figure 4C:
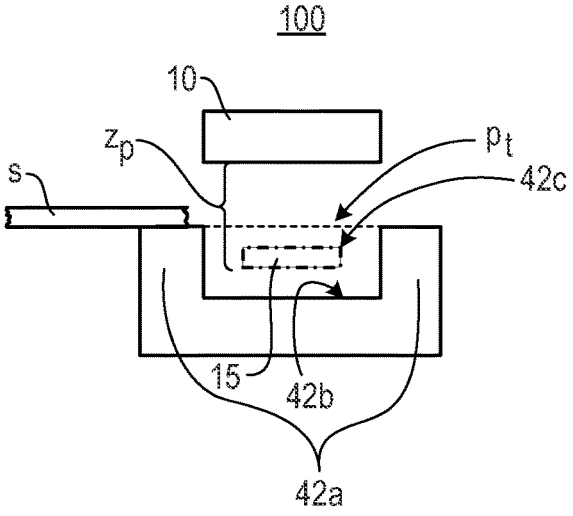
FIG. 4C is a cross-sectional view along line 4C-4C of the portion of the image forming system of FIG. 4B including a fluid applicator unit according to an example.

FIG. 4A is a perspective view illustrating a platen of the image forming system of FIG. 1 according to an example. FIG. 4B is a schematic top view of a portion of the image forming system of FIG. 1 including the platen according to an example. For clarification of the illustration, the fluid applicator unit has been omitted from FIG. 4B. FIG. 4C is a cross-sectional view along line 4C-4C of the portion of the image forming system of FIG. 4B including a fluid applicator unit according to an example. Referring to FIGS. 4A-4C, in some examples, the substrate positioning unit 12 (FIG. 1) may include a platen 42 including a plurality of positioning members 42*a* spaced apart from each other, an upper surface 42*b* disposed between the positioning members 42*a*, and an area 42*c* formed between the upper surface 42*b* and the positioning members 42*a* to form at least a portion of the collector transport path $p_c$.

The positioning members 42*a* may be configured to position the substrate s in the printzone $z_p$ (FIG. 4C) above the upper surface 42*c* and the collector transport path $p_c$. In some examples, the positioning members 42*a* may be arranged traverse to a length of the substrate. Alternatively, in some examples, the positioning members 42*a* may be arranged substantially parallel with a length of the substrate. Additionally, in some examples, the positioning members 42*a* and the upper surface 42*b* of the platen 42 may be integrated as a single piece. Alternatively, in some examples, the positioning members 42*a* may be removably attached to form the platen 42. The printzone $z_p$, for example, may include a region extending between the fluid applicator unit 10 and the collector transport path $p_c$ in which fluid may be conveyed to the substrate and/or collector substrate 15.

Figure 5:
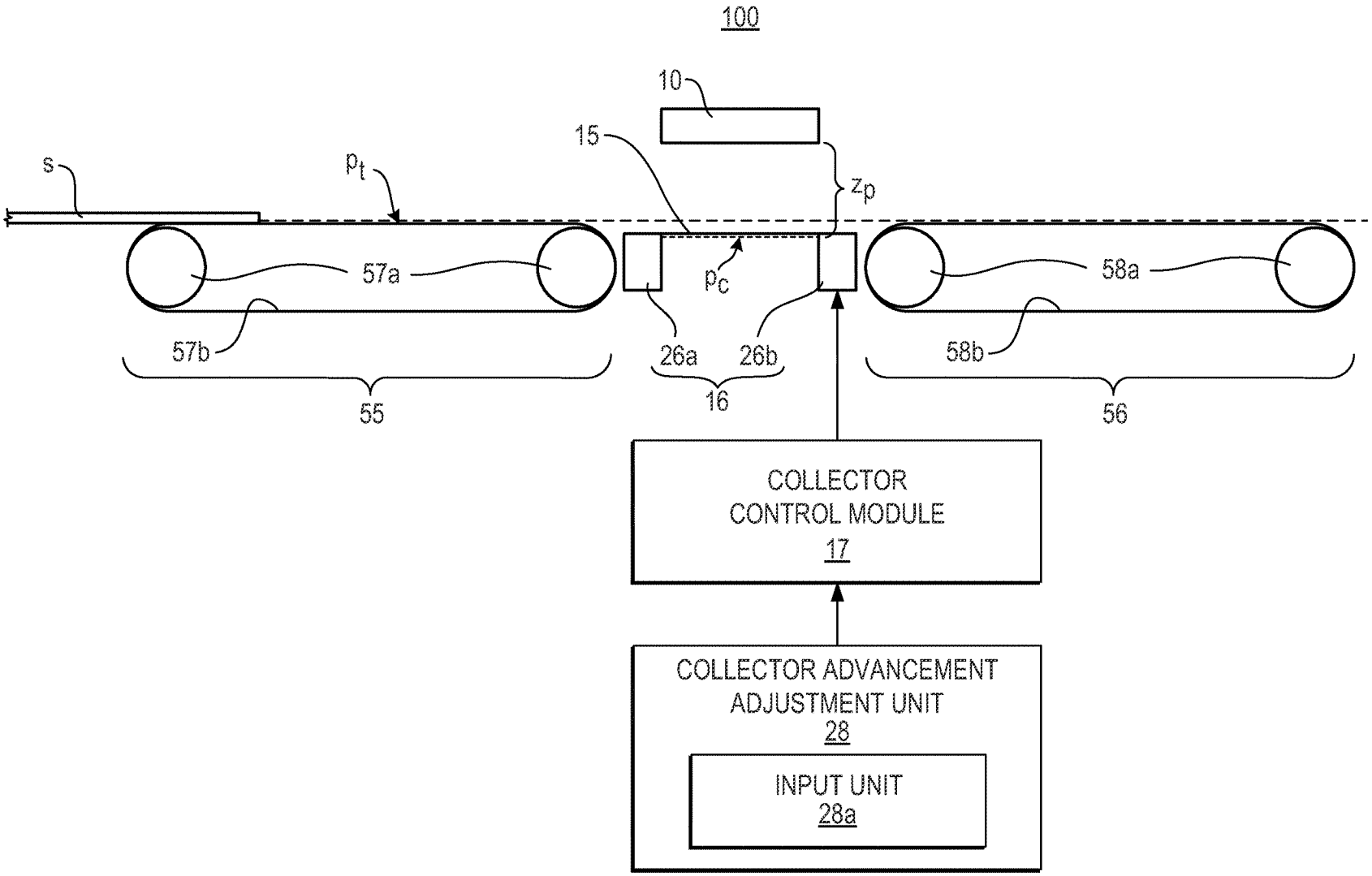
FIG. 5 is a schematic side view illustrating a plurality of belt assemblies of the image forming system of FIG. 1 according to an example.

FIG. 5 is a schematic side view illustrating a substrate positioning unit including a plurality of belt assemblies of the image forming system of FIG. 1 according to an example. Referring to FIG. 5, in some examples, the substrate positioning unit 12 may include a first belt assembly 55 and a second belt assembly 56. The first belt assembly 55 may include a first set of rollers 57*a* and a first belt 57*b* movable there about to transport the substrate s along a transport path $p_t$ to the printzone $z_p$. The second belt assembly 56 may include a second set of rollers 58*a* a second belt 58*b* movable there about to transport the substrate s along the transport path $p_t$ from the printzone. $z_p$ In some examples, the collector advancement unit 16 may be disposed between the first belt assembly 55 and the second belt assembly 56. That is, the collector advancement unit 16 may positioned and continually advance the collector substrate 15 and/or portions thereof while below the transport path $p_t$ and between the first belt assembly 55 and the second belt assembly 56 to receive a second portion of the fluid, for example, applied by the fluid applicator unit 10 and passing through the substrate s.

Figure 6:
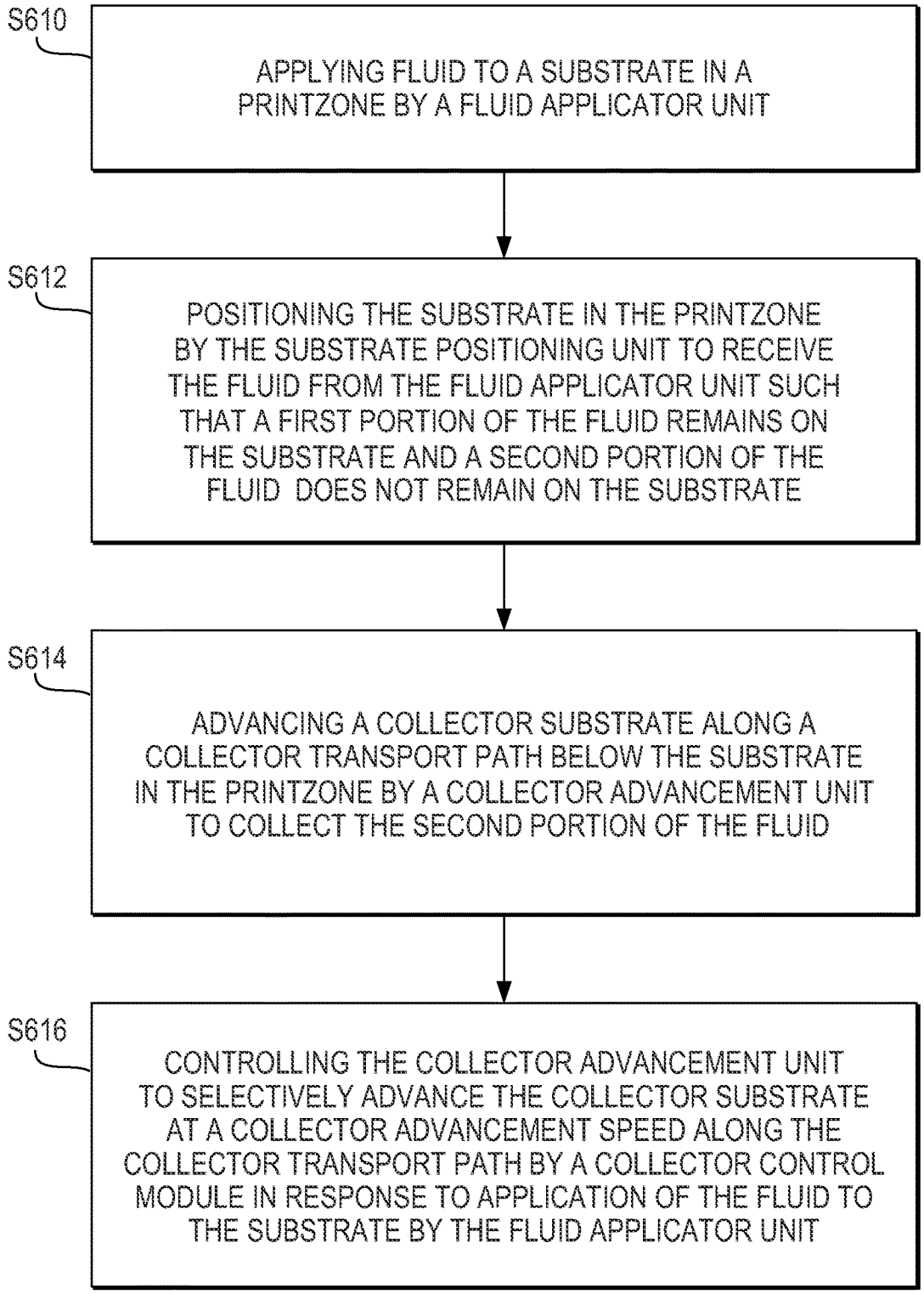
FIG. 6 is a flowchart illustrating a method of collecting fluid in an image forming system according to an example.

FIG. 6 is a flowchart illustrating a method of collecting fluid in an image forming system according to an example. Referring to FIG. 6, in block S610, fluid is applied to a substrate in a printzone by a fluid applicator unit. In block S612, the substrate is positioned in the printzone by the substrate positioning unit to receive the fluid from the fluid applicator unit such that a first portion of the fluid remains on the substrate and a second portion of the fluid does not remain on the substrate. In block S614, a collector substrate is advanced along a collector transport path below the substrate in the printzone by a collector advancement unit to collect the second portion of the fluid. In block S616, the collector advancement unit is controlled to selectively advance the collector substrate at a collector advancement speed along the collector transport path by a collector control module in response to application of the fluid to the substrate by the fluid applicator unit.

In some examples, the collector control module may control the collector advancement unit by continually moving the collector substrate in an uninterrupted manner at the collector advancement speed while the fluid applicator unit is applying the fluid to the substrate. For example, the collector control module may also control the collector advancement unit by maintaining the collector substrate stationary when the fluid applicator unit is not applying the fluid to the substrate. In some examples, the method may also include allowing a user to change the collector advancement speed of the collector substrate in real-time by a collector advancement adjustment unit. In some examples, the collector substrate may be advanced by discrete movements in response to application of the fluid to the substrate by the fluid applicator unit. For example, the collector substrate may be advanced a predetermined amount with respect to each printed swath.

It is to be understood that the flowchart of FIG. 6 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 6 illustrates a specific order of execution, the order of execution may differ from that which is depicted. For example, the order of execution of two or more blocks may be scrambled relative to the order illustrated. Also, two or more blocks illustrated in succession in FIG. 6 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. An image forming system, comprising:

a fluid applicator unit to apply fluid to a substrate;

a substrate positioning unit to position the substrate in a printzone to receive the fluid from the fluid applicator unit such that a first portion of the fluid remains on the substrate and a second portion of the fluid does not remain on the substrate; and a fluid collector assembly including:

a collector substrate to collect the second portion of the fluid in the printzone directly below the substrate;

a collector advancement unit to advance the collector substrate along a collector transport path directly below the substrate in the printzone, wherein the collector substrate and the substrate travel parallel to each other within the printzone; and a collector control module to control the collector advancement unit to selectively advance the collector substrate along the collector transport path in response to application of the fluid to the substrate by the fluid applicator unit.

2. The image forming system according to claim 1, wherein the collector control module is configured to control the collector advancement unit to selectively advance the collector substrate along the collector transport path in response to application of the fluid to the substrate by the fluid applicator unit at a collector advancement speed.

3. The image forming system according to claim 2, wherein the collector control module is configured to control the collector advancement unit to selectively advance the collector substrate along the collector transport path in response to application of the fluid to the substrate by the fluid applicator unit at a collector advancement speed further comprises:

the collector control module to control the collector advancement unit to continually move the collector substrate in an uninterrupted manner at a collector advancement speed while the fluid applicator unit is applying the fluid to the substrate; and the collector control module to control the collector advancement unit to maintain the collector substrate stationary when the fluid applicator unit is not applying fluid to the substrate.

4. The image forming system according to claim 1, wherein the collector transport path is substantially perpendicular to a transport path of at least one of the substrate and the fluid applicator unit, such that used collector substrate is open to direct, visual examination to assess an amount of accumulated printing fluid in the collector substrate.

5. The image forming system according to claim 1, further comprising:

a collector advancement adjustment unit including an input member to allow a user to change a collector advancement parameter corresponding to advancement of the collector substrate in real-time.

6. The image forming system according to claim 5, wherein the collector advancement parameter comprises a collector advancement speed.

7. The image forming system according to claim 1, wherein the collector advancement unit further comprises:

a first collector storage unit to store the collector substrate to be selectively advanced along the collector transport path to the printzone such that the first collector storage unit is disposed at one end of the collector transport path; and a second collector storage unit to receive the collector substrate selectively advanced from the first collector storage unit such that the second collector storage unit is disposed at another end of the collector transport path.

8. The image forming system according to claim 7, wherein the collector substrate extends along the collector transport path in a state of tension between the first collector storage unit and the second collector storage unit.

9. The image forming system according to claim 1, wherein the collector substrate has a thickness less than 0.5 millimeters.

10. The image forming system according to claim 1, wherein the substrate positioning unit comprises:

a platen including a plurality of positioning members spaced apart from each other, an upper surface disposed between the positioning members, and an area formed between the upper surface and the positioning members to form at least a portion of the collector transport path, and wherein the positioning members are configured to position the substrate in the printzone above the upper surface and the collector transport path.

11. The image forming system according to claim 1, wherein the substrate positioning unit comprises:

a first belt assembly including a first set of rollers and a first belt movable there about to transport the substrate along a substrate transport path to the printzone; and a second belt assembly including a second set of rollers and a second belt movable there about to transport the substrate along the substrate transport path from the printzone.

12. The image forming system according to claim 1, wherein the collector advancement unit is disposed between the first belt assembly and the second belt assembly.

13. A method of collecting fluid in an image forming system, the method comprising:

applying fluid to a substrate in a printzone by a fluid applicator unit;

positioning the substrate in the printzone by the substrate positioning unit to receive the fluid from the fluid applicator unit such that a first portion of the fluid remains on the substrate and a second portion of the fluid does not remain on the substrate;

advancing a collector substrate along a collector transport path directly below the substrate in the printzone by a collector advancement unit to collect the second portion of the fluid, wherein the collector transport path within the printzone is linear; and controlling the collector advancement unit to selectively advance the collector substrate at a collector advancement speed along the collector transport path by a collector control module in response to application of the fluid to the substrate by the fluid applicator unit.

14. The method according to claim 13, wherein the controlling the collector advancement unit to selectively advance the collector substrate at a collector advancement speed along the collector transport path by a collector control module further comprises:

continually moving the collector substrate in an uninterrupted manner at the collector advancement speed while the fluid applicator unit is applying the fluid to the substrate; and maintaining the collector substrate stationary when the fluid applicator unit is not applying the fluid to the substrate.

15. The method according to claim 13, further comprising:

allowing a user to change the collector advancement speed of the collector substrate in real-time by a collector advancement adjustment unit.

16. An image forming system, comprising:

a media traveling in a first direction through a printzone;

a fluid applicator unit to apply printing fluid to the media;

a collector substrate located opposite the media from the fluid applicator, the collector substrate directly below the media; and a collector substrate advancement unit to advance the collector substrate in the first direction in response to application of printing fluid to the media, wherein a first portion of the printing fluid applied to the media remains on the media and a second portion of the printing fluid applied to the media is transferred to the collector substrate, and the media travels through the printzone parallel to a surface of the collector substrate and the media maintains contact with the collector substrate as the media travels through the printzone.

17. The system of claim 16, wherein the media is porous.

18. The system of claim 16, wherein the media is a textile.

19. The system of claim 16, wherein after contacting the media, the collector substrate enters a bend exposing a surface of the collector substrate which absorbed the second portion of the printing fluid from the media, such that the exposed surface of the collector substrate allows optically assessment of usage of the collector substrate.

20. The system of claim 16, wherein the fluid applicator unit is static.

* * * * *